US005129730A

United States Patent [19]

Someah et al.

[11] Patent Number: 5,129,730

[45] Date of Patent: Jul. 14, 1992

[54] FLUID MIXING DEVICE

[75] Inventors: Kaveh Someah, Milwaukee; Walter J. Baron, Mequon, both of Wis.

[73] Assignee: CSB Limited Partnership, A Wisconsin Limited Partnership, Milwaukee, Wis.

[21] Appl. No.: 674,804

[22] Filed: Mar. 25, 1991

[51] Int. Cl.[5] ..... B01F 15/04

[52] U.S. Cl. ..... 366/160; 137/101.11; 137/564.5; 234/331; 234/416.5

[58] Field of Search ..... 360/152, 160, 162, 16, 360/17, 8, 151, 161; 137/101.11, 564.5; 239/310, 416.5, 407, 331, 368

[56] References Cited

U.S. PATENT DOCUMENTS

| | | | |
|---|---|---|---|
| 2,227,646 | 1/1941 | Hillmann | 299/84 |
| 3,194,444 | 7/1965 | Hubert | 222/193 |
| 3,351,290 | 11/1967 | Baldwin | 239/276 |
| 3,392,753 | 7/1968 | Kleinmann | 137/564.5 |
| 3,556,141 | 1/1971 | Hind | 137/564.5 |
| 3,669,357 | 6/1972 | Overbey | 239/310 |
| 3,690,340 | 9/1972 | Sipin | 137/93 |
| 3,797,708 | 3/1974 | Sypal | 222/193 |
| 3,833,177 | 9/1974 | Pasley et al. | 239/201 |
| 3,968,932 | 7/1976 | Kimmell | 239/142 |
| 3,974,847 | 8/1976 | Hodges | 137/101.11 |
| 4,047,541 | 9/1977 | Mercier | 137/564.5 |
| 4,121,767 | 10/1978 | Jensen | 239/71 |
| 4,244,494 | 1/1981 | Colgate et al. | 222/1 |
| 4,354,762 | 10/1982 | Cantoni | 366/160 |
| 4,406,406 | 9/1983 | Knapp | 239/313 |
| 4,448,540 | 5/1984 | McLeod | 366/160 |
| 4,456,176 | 6/1984 | Agius | 239/142 |

*Primary Examiner*—Robert W. Jenkins
*Attorney, Agent, or Firm*—Quarles & Brady

[57] ABSTRACT

A fluid mixing valve has a canister which defines a piston chamber divided into an upper additive subchamber and a lower carrier subchamber by a piston. A pressurized carrier liquid enters the carrier subchamber through an inlet and exits the carrier subchamber through a restriction, which produces a pressure differential across the piston to pressurize a supply of additive liquid held within the additive subchamber above the piston. The pressurized additive liquid is injected past an adjustable metering valve into the flow stream of carrier liquid downstream of the restriction. As the additive liquid is depleted, the volume of the additive subchamber diminishes and the volume of the carrier subchamber increases as the piston moves upwardly. When the supply of additive liquid is exhausted, in one embodiment a screw plug is used to return the piston to a refill position, thereby enlarging the additive subchamber to prepare it to receive a new supply of additive liquid. In another embodiment, a bypass valve upstream of the inlet is operated to direct pressurized carrier liquid away from the carrier subchamber and to the additive subchamber to return the piston to the refill position. In this embodiment, a drain is provided to empty the additive subchamber of carrier liquid so that it may be refilled with additive liquid.

10 Claims, 2 Drawing Sheets

FIG. 5
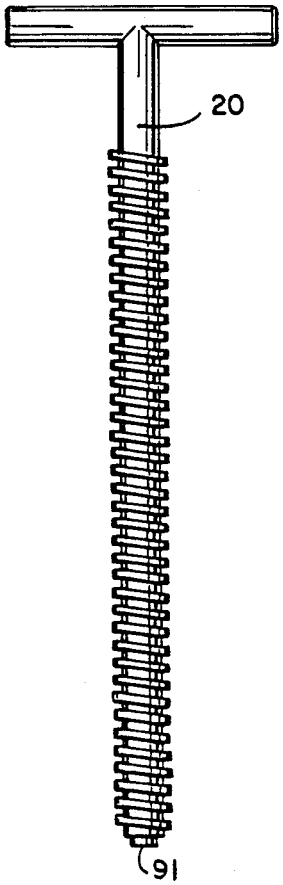
FIG. 1
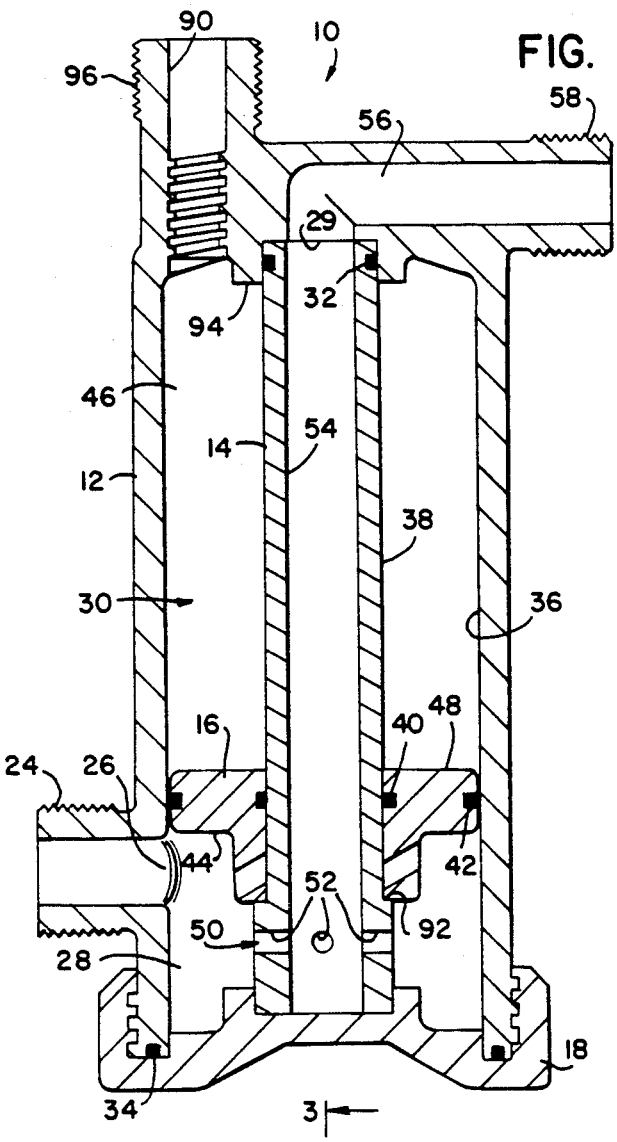
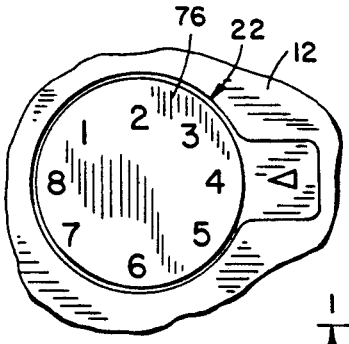
FIG. 4
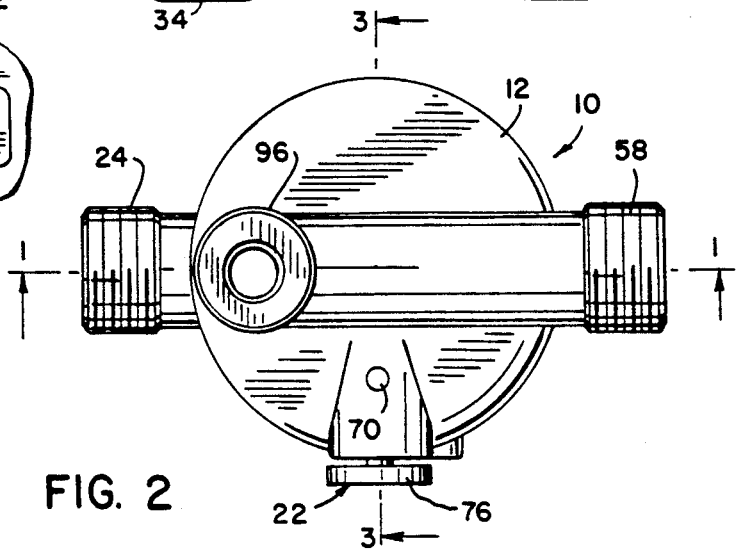
FIG. 2

FLUID MIXING DEVICE

BACKGROUND OF THE INVENTION

This invention relates to devices for making fluids for the type in which a metered amount of an additive liquid is dispensed to a flowing stream of a carrier liquid, and particularly but not limited to such a device for adding an additive liquid such as a fertilizer, herbicide or other type of fluid to a flowing stream of water.

DISCUSSION OF THE PRIOR ART

Fluid mixing devices for adding a metered quantity of an additive liquid to a flowing stream of a primary carrier liquid are well known. For example, such devices are commonly available in gardening stores for connection to the end of a garden hose. These devices typically have a canister for the additive liquid and a venturi created by the water flowing through a restriction in the device produces a vacuum which entrains the additive liquid through an orifice at a certain proportionate mixing ratio.

Other types of fluid mixing devices are also known. In one type, pressurized water is introduced into the device and passed through a series of flow restrictions. Water which does not flow through the flow restrictions is diverted downwardly to a pressure casing or jar which contains a central piston cylinder within which the additive liquid is held and which has a piston separating the additive liquid above it from the pressurized water below it. The additive liquid is pressurized in the piston cylinder and dispensed through a fixed orifice at the top of the piston cylinder into the flow of water downstream from the restrictors. From there, the mixture of additive liquid and water is dispensed out the nozzle of the device.

In such fluid mixing devices, the water in the pressure casing or jar which is intended to exert an upward pressure on the piston can become stagnated. If there is then even only a small amount of leakage of the additive liquid past the piston into the pressurized water held in the jar, the concentration of additive liquid in the stagnated water in the jar can become excessive. This can result in wasting the additive liquid or in accidental adverse consequences from dispensing or disposing of the overly concentrated mixture held in the jar. In addition, if the flow passage of the pressurized water to the jar becomes blocked, the additive liquid stops being dispensed into the flowing stream of water when the pressure on it subsides, although liquid (i.e. only water) would continue to be dispensed from the device. A user would not know this condition and therefore would be deceived into thinking that a mixture of the additive and the water was being dispensed, when in fact only the water was being dispensed. Thus, a need exists for an improved fluid mixing device which overcomes these disadvantages.

SUMMARY OF THE INVENTION

The invention provides an improved fluid mixing device for dispensing a metered quantity of an additive liquid to a flowing stream of a carrier liquid. The device includes a canister having a piston chamber within it and a piston reciprocable within the piston chamber. The piston divides the piston chamber into an additive subchamber on an additive side of the piston and a carrier subchamber on a carrier side of the piston. The piston forms a sliding seal with the piston chamber between the additive and carrier subchambers so that the volumes of the additive and carrier subchambers vary inversely relative to each other as the piston moves. An inlet in the canister is for connection to a source of pressurized carrier liquid and opens into the carrier subchamber upstream of the carrier subchamber. A flow restriction opens into the carrier subchamber downstream of the carrier subchamber. The carrier subchamber forms an unrestricted flow passage of the carrier liquid between the inlet and the flow restriction. An outlet is in the canister for dispensing a flow of a mixture of the additive liquid and the carrier liquid and a flow passage extends from the restriction to the outlet. Metering means provides communication between the flow passage and the additive subchamber for dispensing a metered amount of additive liquid from the additive subchamber to the flow of carrier liquid in the flow passage. With this construction, the carrier liquid flows through the piston chamber and must first flow past the carrier side of the piston before exiting the canister. As a result, the carrier liquid in the carrier subchamber is constantly turning over with fresh water and does not become stagnated. In addition, if a blockage develops in the flow passage to the piston chamber, flow of carrier fluid through the device would be stopped so that a user would be informed of a problem.

In an especially preferred form, the piston chamber and the piston are annular, with the piston chamber having an outer cylindrical wall and an inner cylindrical wall. The inlet opens in one of the cylindrical walls and the flow restriction opens in the other of the cylindrical walls. This provides for a readily manufacturable unit composed largely of cylindrical and tubular parts which can be readily molded or fabricated.

In another useful form, the metering means includes an adjustable valve for selectively varying the proportionate mixture of additive liquid to carrier liquid which is dispensed from the device. The device may also be refillable with additive liquid, and to this end, means are provided in a preferred form for moving the piston to increase the volume of the additive subchamber and reduce the volume of the carrier subchamber so as to return the piston to a refill position. In one form, the returning means includes a screw plug which can be turned to abut the piston to thereby return it to the refill position.

In an alternate form, the returning means includes a valve for admitting pressurized liquid into the additive subchamber, which serves to displace any carrier liquid remaining in the carrier subchamber out of the carrier subchamber and return the piston to the refill position. A drain valve is openable into the additive subchamber after the piston has been returned to the refill position as so to drain carrier liquid from the additive subchamber. Preferably, the return valve is a bypass valve upstream of the inlet to the carrier subchamber so as to direct carrier liquid away from the carrier subchamber and to the additive subchamber.

BRIEF DESCRIPTION OF THE DRAWINGS

FIG. 1 is a cross-sectional view of a fluid mixing device of the invention taken from the plane of the line 1—1 of FIG. 2;

FIG. 2 is a top plan view of the device shown in FIG. 1;

FIG. 4 is a detail view of an adjustment knob for metering the proportion of additive liquid dispensed into the carrier liquid in the device of FIG. 1;

FIG. 5 is a side elevation view of a plug screw for the device of FIG. 1; and

DETAILED DESCRIPTION OF THE PREFERRED EMBODIMENTS

Figure 3:
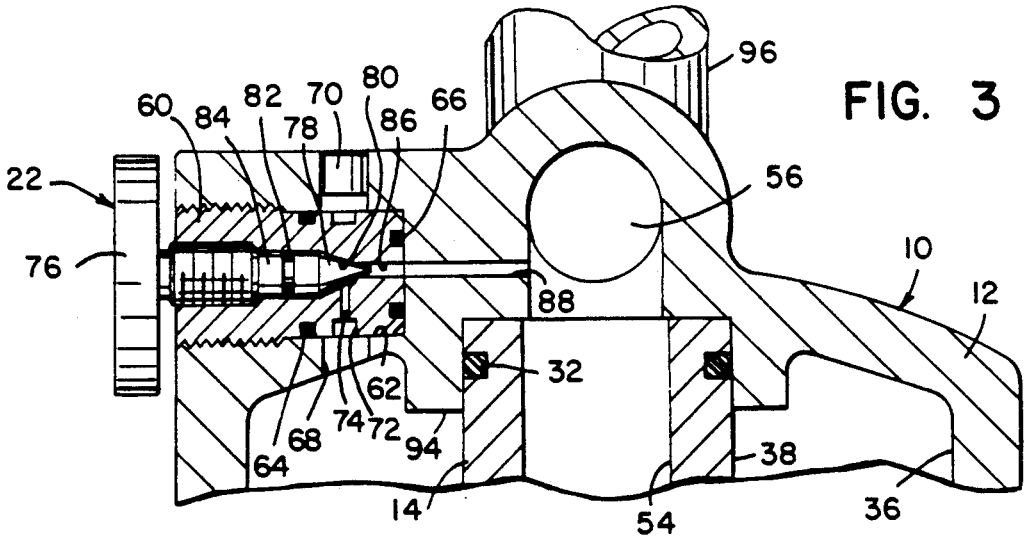
FIG. 3 is a fragmentary cross-sectional view of the device of FIG. 1 taken from the plane of the line 3—3 of FIG. 2.

FIG. 1 discloses a fluid mixing device 10 of the present invention including a generally cylindrical canister 12, a tubular flow passage 14, a piston 16 and a cover 18. The fluid mixing device 10 also includes a screw plug 20 shown in FIG. 5 and a metering valve 22 shown in FIGS. 2-4.

The fluid mixing device 10 is intended for stationary mounting with the central longitudinal axis of the canister 12 generally vertical. The fluid mixing device 10 could be used for dispensing a metered quantity of an additive liquid to a flowing stream of a carrier liquid. A common application for which the fluid mixing device 10 is intended is in a water irrigation system to add fertilizer or a herbicide to the irrigation water. However, other carrier liquids and additive liquids could be used and the fluid mixing device 10 could be adapted to be a portable hose mounted unit, rather than one suited for incorporation in a piping system.

The canister 12 has a nipple 24 at its lower end which forms an inlet 26 to a carrier subchamber 28 of piston chamber 30 within canister 12. The nipple 26 has external threads for connection to a pipe or other suitable source of pressurized carrier liquid, for example to a city water supply. The flow passage tube 14 is inserted centrally into the canister 12 with its top end seated in an annular recess 29 at the top of the canister 12 and an O-ring 32 forming a seal between the top of the flow passage 14 and the canister 12. The bottom of the flow passage 14 is seated in a cylindrical recess of the cover 18 and the cover 18 is screwed onto the bottom end of the canister 12 with an O-ring seal 34 forming a seal between the cover 18 and the canister 12.

Cylindrical wall 36 of canister 12 and a cylindrical outer surface 38 of flow passage 14 form the annular piston chamber 30. The piston 16 is correspondingly annular and has a sliding O-ring seal 40 which forms a seal between the inner diameter of piston 16 and surface 38 and a sliding O-ring seal 32 which forms a seal between the outer diameter of piston 16 and cylindrical surface 36.

The piston 16 divides the piston chamber 30 into the carrier subchamber 28 below carrier side 44 of piston 16 and an additive subchamber 46 above additive side 48 of the piston 16. The piston 16 can reciprocate longitudinally within the piston chamber 30 while forming a sliding liquid-tight seal via O-rings 40 and 42 between the additive subchamber 46 and the carrier subchamber 28.

The carrier subchamber 28 forms an unrestricted flow passaged from inlet 26 to a flow restriction 50 in the base of the flow passage 14. The flow restriction 50 is formed by four holes 52 spaced apart by 90° which open into the carrier subchamber 28. The restriction 50 provided by the holes 52 restricts passage of carrier fluid from the carrier subchamber 28 into lumen 54 of flow passage 14, which produces a pressure drop from the carrier subchamber 28 to the lumen 54. This pressure difference produces an upward force on piston 16 to pressurize additive liquid contained within additive subchamber 46. The pressure exerted upon the additive liquid in the additive subchamber 46 by the piston 16 causes additive liquid to be injected past metering valve 22 into the flowing stream of carrier liquid downstream of the restriction 50. Therefore, as the additive liquid is dispensed from the additive subchamber 46, the piston 16 moves upwardly under the influence of pressure in the carrier subchamber 28, and the volume of additive subchamber 46 is diminished and the volume of carrier subchamber 28 is correspondingly increased.

The upper end of lumen 54 is in communication with outlet passage 56 which opens to the exterior of the canister 16 through outlet nipple 58. Outlet nipple 58 has external threads for connection to a pipe or hose for dispensing the mixture of additive liquid and carrier liquid.

Referring to FIG. 3, the metering valve 22 includes a housing 60 which is threaded into bore 62 in canister 12 and sealed against the bore 62 by O-rings 64 and 66. A bore 68 is formed through the top wall of the canister 12, through the bore 62 and into communication with the top of the additive subchamber 46. A plug 70 seals the top of the bore 68 so as to prevent leakage from the additive subchamber 46. The valve housing 60 has an annular groove 72 which provides communication between bore 68 and bore 74 in the housing 60. Needle valve 76 is threaded into housing 60 and has cone shaped end 78 which seats against a mating cone shaped surface 80 in the housing 60. O-ring 82 forms a seal between shank portion 84 of needle valve 76 and the housing 60. Bore 74 opens into a side of cone shaped surface 80 and a bore 86 in the housing 60 opens into the tip of cone shaped surface 80. Bore 86 is in communication with bore 88 in canister 12 which leads to outlet passage 56. Thereby, needle valve 76 can be turned to vary an orifice between additive subchamber 46 and outlet passage 56 to adjustably select the proportion of additive liquid mixed into the carrier liquid.

Screw plug 20 is screwed into the top of canister 12 through bore 90 and is removable therefrom to refill additive subchamber 46. Screw plug 20 has a relatively long length of threads and is parallel to the piston chamber longitudinal axis so that after the supply of additive liquid has been depleted from additive subchamber 46 and the piston 16 has moved to a relatively high position, the screw plug 20 can be turned in bore 90 with its end 91 abutting additive side 48 of piston 16 to return piston 16 to a refill position (shown in FIGS. 1 and 6) toward the bottom of the piston chamber 30 so as to enlarge the additive subchamber 46 and correspondingly reduce the carrier subchamber 28.

The exterior surface of the flow passage 14 can be made with a shoulder 92 to act as a downward stop for the piston 16 and surface 94 near the top of the additive subchamber 46 can provide an upward stop for the piston 16. Preferably, the canister 12 is made of a transparent plastic material so that the position of the piston 16 can be readily observed, or it could be made of a non-transparent material and a sight glass provided. After the screw plug 20 is used to return the piston 16 to its refill position in the piston chamber 30, the screw plug 20 is unscrewed from the bore 90 so that its end 91 is near the top of the piston chamber 30 so that the piston 16 may move upwardly under the pressure exerted by the carrier liquid. The threads on screw plug 20 are shaped so as to form a seal between the screw plug 20 and the canister 12 and a threaded nipple 96 may also be provided to receive a cap (not shown) for providing an additional or auxiliary seal against leakage of the additive liquid from the additive subchamber 46.

There has been described above a fluid mixing device in which a carrier liquid inlet opens into a carrier subchamber of a piston chamber in which a piston is interposed immediately downstream of the inlet and upstream of a restriction. All flow from the inlet must first flow through the carrier subchamber past the carrier side of the piston before it can exit the carrier subchamber through the flow restriction, which serves to reliably produce a positive pressure on the additive liquid supply. The carrier subchamber provides unrestricted flow between the inlet and the flow restriction. With the piston interposed between the inlet and flow restriction, there can be no flow of carrier liquid without the additive chamber being pressurized.

Figure 6:
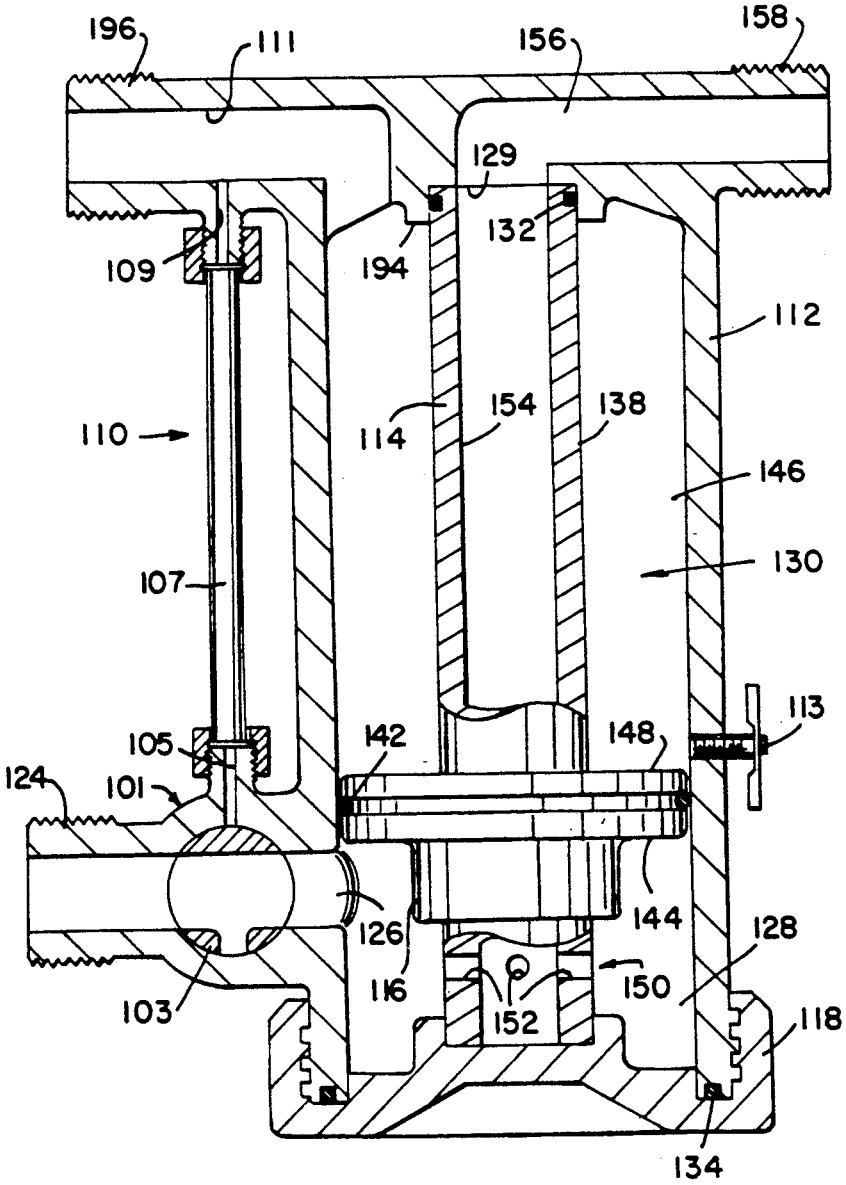
FIG. 6 is a sectional view similar to FIG. 1 of a second embodiment of a fluid mixing device of the invention.

FIG. 6 illustrates an alternate embodiment 110 which is similar in all respects to the device 10 of FIG. 1 except that other means are provided for returning the piston 116 to its refill position. Corresponding reference numerals plus 100 are used in the embodiment of FIG. 6 to identify corresponding components.

In the fluid mixing device 110 shown in FIG. 6, a bypass valve 101 is interposed between nipple 124 and inlet 126. The bypass valve 101 includes a rotatable valve cock member 103 which can be rotated to selectively provide communication between nipple 126 and inlet 124, as shown in FIG. 6, or between nipple 126 and bore 105 in canister 112. To provide communication between inlet nipple 126 and bore 105, the valve cock 103 is turned 90° clockwise as viewed in FIG. 6 from the position shown in FIG. 6. Tube 107 provides communication between bore 105 and a bore 109 of canister 112 which is in communication with the top of the additive chamber 146 via passageway 111. Passageway 111 also opens outwardly of canister 112 through refill nipple 196 which would normally be capped but could also be connected to an auxiliary source of fluid pressure to return piston 116 to its lower position. A drain valve 113 is in communication with the piston chamber 130 just above the refill position of the piston 116 so that pressurized carrier liquid or other pressurized liquid for returning the piston 116 to its refill position can be drained from the additive subchamber 146 after the bypass valve 101 is closed. With the drain valve 113 open and with the piston 116 in the refill position, opening refill nipple 196 ventilates air into the additive chamber 146 so that the carrier liquid can drain therefrom through valve 113, following which valve 113 is closed and the chamber 146 refilled through nipple 196 with carrier liquid. Note that as the chambers 46 or 146 are enlarged, either with a screw plug 20 or by using bypass valve 101, carrier liquid remaining in the carrier chamber 128 is pressed out through restriction 50 or 150 and through the outlet 58.

In the preferred embodiment, the inlet 26, lumen 54 and outlet passage 56 are approximately 9/16 inches in diameter, the four holes 52 are each approximately 7/32 inches in diameter, the inside diameter of the cylindrical surface 36 is approximately 3 inches, and the outside diameter of the cylindrical surface 38 is approximately 1⅛ inches. At an inlet pressure of approximately 40 psi or greater, these dimensions produce a pressure drop between the inlet nipple 24 and the outlet nipple 58, which is sufficient to inject additive liquid into the stream of carrier liquid flowing through the device 10.

Preferred embodiments of a fluid mixing device of the invention has been described in detail above. Numerous modifications and variations to the preferred embodiments described will be apparent to those of ordinary skill in the art which will still be within the spirit and scope of the invention. For example, the piston chamber could be made cylindrical, rather than annular, with the inlet opening into the carrier chamber upstream of the carrier chamber and the restriction opening into the carrier chamber downstream of the carrier chamber. Therefore, the invention should not be limited to the scope of the foregoing description and drawings, but should be defined by the claims that follow.

We claim:

1. A fluid mixing device for dispensing a metered quantity of an additive liquid to a flowing stream of a carrier liquid, comprising:

a canister;

a piston chamber within said canister;

a piston reciprocable within said piston chamber, said piston dividing said piston chamber into an additive subchamber on an additive side of said piston and a carrier subchamber on a carrier side of said piston, said piston forming a sliding seal with said piston chamber between said additive and carrier subchambers;

an inlet in said canister for connection to a source of pressurized carrier liquid, said inlet opening into said carrier subchamber upstream of said carrier subchamber;

a flow restriction opening into said carrier subchamber downstream of said carrier subchamber;

wherein said carrier subchamber forms an unrestricted flow passage of the carrier liquid between the inlet and the flow restriction;

an outlet in said canister for dispensing a flow of a mixture of the additive liquid and the carrier liquid;

a flow passage from said restriction to said outlet; and metering means providing communication between said flow passage and said additive subchamber for dispensing a metered amount of additive liquid from said additive subchamber to the flow of carrier liquid in the flow passage.

2. A flow mixing device as in claim 1, wherein the carrier subchamber is at least partially below the additive subchamber.

3. A fluid mixing device as in claim 2, wherein said inlet opens into a bottom portion of the piston chamber and the metering means is in communication with a top portion of the piston chamber, and said piston is between said inlet and said metering means.

4. A fluid mixing device as in claim 1, wherein the piston chamber and the piston are annular, said piston chamber has an outer cylindrical wall and an inner cylindrical wall, and the inlet opens in one of said cylindrical walls and the flow restriction opens in the other of said cylindrical walls.

5. A fluid mixing device as in claim 1, wherein said metering means includes an adjustable valve for selectively varying the proportionate mixture of additive liquid to carrier liquid which is dispensed from the device.

6. A fluid mixing device as in claim 1, further comprising means for moving the piston to increase the volume of the additive subchamber and reduce the volume of the carrier subchamber so as to, return the piston to a refill position.

7. A fluid mixing device as in claim 6, wherein said returning means comprises a screw plug for abutting the piston to return it to the refill position.

8. A fluid mixing device as in claim 6, wherein said returning means comprises a valve for admitting pressurized liquid into said additive subchamber.

9. A fluid mixing device as in claim 8, wherein said return valve is for admitting pressurized carrier liquid into said additive subchamber and further comprising a drain valve openable into said additive subchamber after said piston has been returned to the refill position as so to drain carrier liquid from said additive subchamber.

10. A fluid mixing valve as in claim 9, wherein said return valve is a bypass valve upstream of the inlet to the carrier subchamber.

* * * * *